US010557179B2

(12) United States Patent
Shin et al.

(10) Patent No.: US 10,557,179 B2
(45) Date of Patent: Feb. 11, 2020

(54) METHOD FOR MANUFACTURING REDUCED IRON

(71) Applicants: POSCO, Pohang-si, Gyeongsangbuk-do (KR); Primetals Technologies Austria GmbH, Linz (AT)

(72) Inventors: Myoung-Kyun Shin, Pohang-si (KR); Dong-Won Kim, Pohang-si (KR); Sang-Hyun Kim, Pohang-si (KR); Jun-Hyuk Lee, Pohang-si (KR); Jan Friedemann Plaul, Linz (AT); Norbert Rein, Vienna (AT); Karl Zehetbauer, Feldkirchen (AT)

(73) Assignees: POSCO, Pohang-si (KR); Primetals Technologies Austria GmbH, Linz (AT)

( * ) Notice: Subject to any disclaimer, the term of this patent is extended or adjusted under 35 U.S.C. 154(b) by 142 days.

(21) Appl. No.: 15/700,212

(22) Filed: Sep. 11, 2017

(65) Prior Publication Data

US 2018/0010202 A1 Jan. 11, 2018

Related U.S. Application Data

(62) Division of application No. 13/496,683, filed as application No. PCT/KR2010/004589 on Jul. 14, 2010, now Pat. No. 9,783,862.

(30) Foreign Application Priority Data

Sep. 17, 2009 (KR) ..... 10-2009-0087824

(51) Int. Cl.

| | |
|---|---|
| ***C21B 13/00*** | (2006.01) |
| ***F27D 17/00*** | (2006.01) |
| ***C21B 13/14*** | (2006.01) |

(52) U.S. Cl.
CPC ..... *C21B 13/0033* (2013.01); *F27D 17/004* (2013.01); *C21B 13/143* (2013.01); (Continued)

(58) Field of Classification Search
CPC ..... C21B 13/0033; C21B 2100/40; C21B 2100/66; C21B 2100/80; F27D 17/004
(Continued)

(56) References Cited

U.S. PATENT DOCUMENTS 3,933,342 A * 1/1976 Schramm ..... C22B 30/02 266/154
5,961,690 A 10/1999 Kepplinger et al.
(Continued)

FOREIGN PATENT DOCUMENTS

CN 101048516 A 10/2007
CN 101104873 A 1/2008
(Continued)

*Primary Examiner* — Scott R Kastler
*Assistant Examiner* — Michael Aboagye
(74) *Attorney, Agent, or Firm* — The Webb Law Firm

(57) ABSTRACT

Provided is a method for manufacturing reduced iron which includes the steps of: i) drying ores in an ore drier; ii) supplying the dried ores to at least one reduction reactor; iii) reducing the ores in the at least one reduction reactor and manufacturing reduced iron; iv) discharging exhaust gas by which the ores are reduced in the reduction reactor; v) branching the exhaust gas and providing the branched exhaust gas as ore feeding gas; and vi) exchanging heat between the exhaust gas and the ore feeding gas and transferring the sensible heat of the exhaust gas to the ore feeding gas. In the supplying the dried ores to the at least one reduction reactor, the dried ores are supplied to the at least one reduction reactor by using the ore feeding gas.

8 Claims, 4 Drawing Sheets

(52) U.S. Cl.
CPC ..... *C21B 2100/40* (2017.05); *C21B 2100/66* (2017.05); *C21B 2100/80* (2017.05)

(58) Field of Classification Search
USPC ..... 266/155, 172, 144, 146; 75/379, 446, 75/450, 392, 453, 754
See application file for complete search history.

(56) References Cited

U.S. PATENT DOCUMENTS

| | | | | |
|---|---|---|---|---|
| 6,372,016 | B1 | 4/2002 | Kamikawa et al. | |
| 6,482,351 | B2 | 11/2002 | Kamikawa et al. | |
| 6,551,548 | B2 | 4/2003 | Kamikawa et al. | |
| 7,588,625 | B2 * | 9/2009 | Nam | C21B 13/0013 75/446 |
| 9,783,862 | B2 * | 10/2017 | Shin | C21B 13/0033 |
| 2004/0020326 | A1 * | 2/2004 | Ibaraki | C21B 13/0046 75/313 |

FOREIGN PATENT DOCUMENTS

| | | | | |
|---|---|---|---|---|
| CN | 101260448 | A | 9/2008 | |
| JP | 63192811 | A | 8/1988 | |
| JP | 2209408 | A | 8/1990 | |
| JP | 63241125 | A | 10/1998 | |
| JP | 2002146420 | A | 5/2002 | |
| JP | 2006511707 | A | 4/2006 | |
| KR | 20010029431 | A | 4/2001 | |
| KR | 20020003821 | A | 1/2002 | |
| KR | 20050054849 | A | 6/2005 | |
| WO | 2004/057037 | A1 | 7/2004 | |
| WO | 2005054520 | A1 | 6/2005 | |
| WO | WO 2005054520 | * | 6/2005 | C21B 13/0033 |

* cited by examiner

METHOD FOR MANUFACTURING REDUCED IRON

CROSS-REFERENCE TO RELATED APPLICATION

This application is a divisional of co-pending U.S. application Ser. No. 13/496,683 filed Jul. 14, 2010, now U.S. Pat. No. 9,783,862, which is the United States national phase of International Application No. PCT/KR2010/004589 filed Jul. 14, 2010, which claims priority to and the benefit of Korean Patent Application No. 10-2009-0087824 filed in the Korean Intellectual Property Office on Sep. 17, 2009, the entire contents of which are incorporated herein by reference.

BACKGROUND OF THE INVENTION (a) Field of the Invention

The present invention relates to an apparatus for manufacturing reduced iron and method for manufacturing the same. More particularly, the present invention relates to an apparatus for manufacturing reduced iron and method for manufacturing the reduced iron whereby efficiency for manufacturing reduced iron can be enhanced.

(b) Description of the Related Art

In a smelting reduction process, reduced iron and coal are charged into a melter-gasifier to smelt the reduced iron and manufacture molten irons. The reduced iron charged into the melter-gasifier is manufactured by reducing iron ores with a reducing gas.

The iron ores may be reduced in a fluidized bed reduction reactor or a packed bed reduction reactor. The iron ores are preheated before being charged into a fluidized bed reduction reactor or a packed bed reduction reactor. When the iron ores are preheated, the moisture contained in the iron ores can be removed in advance. Thus, before being charged into a fluidized bed reduction reactor or a packed bed reduction reactor, the iron ores may be prevented from being stuck to each other due to moisture while being stored, discharged, and fed. Further, the iron ores may be prevented from being attached to the interiors of an ore storing device, an ore discharging device, or an ore feeding device. In addition, since the energy necessary for drying iron ores may be reduced after the dried iron ores are charged into the reduction reactor, a smaller amount of reducing gas can be used to convert (reduce) the iron ores into reduced iron.

In particular, fine ores are directly used in a fluidized bed reduction reactor. Thus, the above-mentioned adhesion problem and attachment problem can cause severe operational troubles.

Therefore, there has been a demand for an ore drying apparatus which requires more energy to dry fine ores which are fed into reduction reactor, compared to the energy which is required to dry preliminarily dried ores.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an apparatus for manufacturing reduced iron which can minimize the costs for manufacturing reduced iron. The present invention also provides a method for manufacturing reduced iron which can minimize the costs for manufacturing reduced iron.

An exemplary embodiment of the present invention provides a method for manufacturing reduced iron, including: i) drying ores in an ore drier; ii) supplying the dried ores to at least one reduction reactor; iii) reducing the ores in the at least one reduction reactor and manufacturing reduced iron; iv) discharging exhaust gas by which the ores are reduced in the reduction reactor; v) branching the exhaust gas and providing the branched exhaust gas as ore feeding gas; and vi) exchanging heat between the exhaust gas and the ore feeding gas and transferring the sensible heat of the exhaust gas to the ore feeding gas. In the supplying of the dried ores to the at least one reduction reactor, the dried ores are supplied to the at least one reduction reactor by using the ore feeding gas.

In the supplying of the dried ores to the at least one reduction reactor, a direction in which the dried ores are supplied to the reduction reactor may coincide with a direction in which the ore feeding gas flows and the dried ores may be supplied to the reduction reactor in a linear flow. The supplying of the dried ores to the at least one reduction reactor may include: i) supplying the dried ores along a first direction; and ii) supplying the dried ores along a second direction crossing the first direction and raising the dried ores along the second direction. In the supplying of the dried ores along the first direction, an amount of moisture in the dried ores fed along the first direction may be more than 0 and not more than 7 wt %. The supplying of the dried ores to the at least one reduction reactor may further include supplying the dried ores to the reduction reactor radially while lowering the dried ores along a plurality of third directions crossing the second direction. The supplying of the dried ores to the at least one reduction furnace may further include flowing the dried ores in an air-tight space between the second direction and the third direction.

In the branching of the exhaust gas and providing the branched exhaust gas as an ore feeding gas, the exhaust gas may be compressed before being branched. In the branching of the exhaust gas and providing the branched exhaust gas as an ore feeding gas, after dust contained in the exhaust gas may be collected in a dry fashion, the exhaust gas may be branched. In the transferring of the sensible heat of the exhaust gas to the ore feeding gas, the flow direction of the exhaust gas may be opposite to the flow direction of the ore feeding gas in the heat exchanger. In the supplying of the dried ores to the at least one reduction reactor, the temperature of the ore feeding gas may be 150° C. to 300° C.

Another exemplary embodiment of the present invention provides an apparatus for manufacturing reduced iron, including: i) an ore drier for drying ores; ii) an ore supplier for receiving the dried ores from the ore drier and feeding the dried ores with ore feeding gas; iii) at least one reduction reactor for receiving the dried ores and reducing the dried ores to manufacture reduced iron; iv) an exhaust gas pipe connected to the reduction reactor to discharge the exhaust gas by which the dried ores have been reduced; v) a feeding gas pipe branched from the exhaust gas pipe to provide the ore feeding gas and feed the dried ores from the ore supplier to the reduction reactor with the ore feeding gas; and vi) a heat exchanger through which the exhaust gas pipe and the feeding gas pipe pass to transfer sensible heat of the exhaust gas to the ore feeding gas.

The feeding gas pipe may include: i) a first feeding gas pipe part extending in a first direction; and ii) a second feeding gas pipe part connected to the first feeding gas pipe part and extending along a second direction crossing the first direction, and the second feeding gas pipe part may extend vertically. The feeding gas pipe may further include a plurality of third feeding gas pipe parts connected to the second feeding gas pipe part and extending along a third direction crossing the second direction, and the plurality of third feeding gas pipe parts may be radially connected to the reduction reactor. The feeding gas pipe may further include a distributer mutually connecting the second feeding gas pipe part and the plurality of third feeding gas pipe parts and having an air-tight space therein. The apparatus for manufacturing reduced iron according to another exemplary embodiment of the present invention may further include a gas compressor installed in the exhaust gas pipe to compress the exhaust gas before the exhaust gas is branched. The apparatus for manufacturing reduced iron according to another exemplary embodiment of the present invention may further include a dry collector installed in the exhaust gas pipe to collect dust contained in the exhaust gas in a dry fashion before the exhaust gas is branched. The apparatus for manufacturing reduced iron according to another exemplary embodiment of the present invention may further include an ore supply pipe connecting the ore supplier and the feeding gas pipe, and the ore supply pipe may extend in a direction crossing a direction in which the feeding gas pipe extends. The reduction reactor may be a fluidized bed reduction reactor or a packed bed reduction reactor.

According to the exemplary embodiments of the present invention, fine ores can be directly charged into ore layer formed in the reduction reactor, by drying the fine ores into appropriate level and transferring them into the reduction reactor.

Thus, the ore drying and feeding processes can be made simple, thereby making it possible to reduce the costs for manufacturing reduced iron and enhance process efficiency. Further, mixing efficiency of ores in a reduction reactor can be increased.

DETAILED DESCRIPTION OF THE EMBODIMENTS

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Although not defined in a different way, all the terms including technical terms and scientific terms used herein have the same meanings as the meaning that are generally understood by those skilled in the art to which the present invention pertains. The terms defined in commonly used dictionaries are additionally construed to have the meanings consistent with the related technical documents and the currently disclosed contents, and are not construed to have ideal or very formal meanings as long as they are not defined.

Hereinafter, an apparatus for manufacturing reduced iron is construed to include all apparatuses capable of manufacturing reduced iron. Also, reduced iron may have any shape such as fine particles or compacted iron. Since reduced iron may be used when molten iron is manufactured by an apparatus for manufacturing molten iron, the ingot iron manufacturing apparatus may include an apparatus for manufacturing reduced iron.

Figure 1:
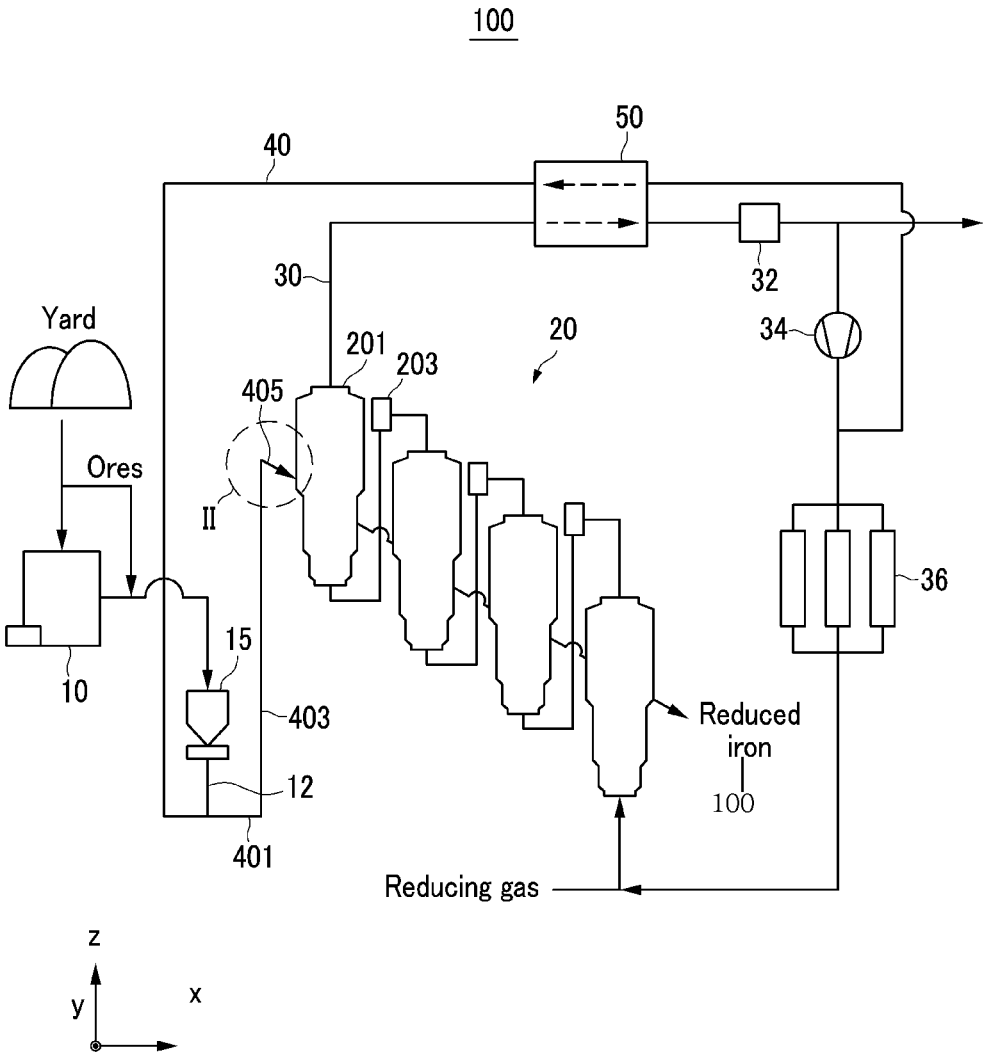
FIG. 1 is a schematic perspective view of an apparatus for manufacturing reduced iron according to a first exemplary embodiment of the present invention.

FIG. 1 schematically shows an apparatus for manufacturing reduced iron 100 according to the first exemplary embodiment of the present invention. The structure of the apparatus for manufacturing reduced iron 100 of FIG. 1 is shown simply to exemplify the present invention, but the present invention is not limited thereto. Thus, the structure of the apparatus for manufacturing reduced iron 100 may be variously modified.

As shown in FIG. 1, the apparatus for manufacturing reduced iron 100 includes an ore drier 10, an ore supplier 15, a reduction unit 20, an exhaust gas pipe 30, a feeding gas pipe 40, and a heat exchanger 50. In addition, the apparatus for manufacturing reduced iron 100 may further include other units.

Ores are transferred from a yard and are supplied to the ore drier 10. An auxiliary material may be mixed with the ores, and the ores may have a wide range of grain sizes. Although not shown in FIG. 1, when the moisture in the iron ores fed from the yard is not more than 7 wt %, the iron ores may not pass through the ore drier 10 but be directly supplied to the ore supplier 15.

The ore drier 10 is operated at the atmospheric pressure and in contact with the air. Thus, the ore supplier 15 for introducing ores while preventing the ores from contacting the air is provided to charge the ores dried by the ore drier 10 into a plurality of reduction reactors 201.

As shown in FIG. 1, the ore supplier 15 receives the ores dried by the ore drier 10. The ore supplier 15 feeds the dried ores by using an ore feeding gas. Here, the ore supplier 15 may feed a proper amount of dried ores.

As shown in FIG. 1, the reduction unit 20 includes a plurality of reduction reactors 201 and a plurality of oxygen burners 203. The plurality of reduction reactors 201 are connected to each other to sequentially feed a reduction gas and reduce the ores charged into the plurality of reduction reactors 201. Reducing gas is supplied to the reduction unit 20 to reduce the ores. Since the temperature of the reducing gas having reduced the ores in each reduction reactor 201 is lowered, the reducing gas is heated by using the oxygen burners 203. As a result, reducing gas having a proper reducing rate can be secured. After being reduced in the reduction unit 20, the ores are converted to reduced iron and are discharged. The ores contact the reducing gas while flowing in the reduction reactors 201 to be reduced. Thus, the reduction reactors 201 serve as fluidized bed reduction reactors. After being introduced into an electric furnace or a melter-gasifier, the reduced iron is smelted to manufacture molten iron.

As shown in FIG. 1, the exhaust gas pipe 30 is connected to the reduction reactor 201. Thus, the exhaust gas pipe 30 discharges the exhaust gas having reduced the dried ores. A dry dust collector 32, a gas compressor 34, and a carbon dioxide remover 36 are installed in the exhaust gas pipe 30. The dry dust collector 32 collects fine particles contained in the exhaust gas in a dry fashion by using a high-temperature ceramic filter. The fine particles contained in the exhaust gas are collected in a dry fashion before being branched by a feeding gas pipe 40. When the fine particles contained in the exhaust gas are collected in a wet fashion, sludge is generated, thereby causing high post-processing costs. Thus, if the fine particles contained in the exhaust gas are eliminated by collecting in a dry fashion with the dry dust collector 32, costs for manufacturing reduced iron can be decreased.

The gas compressor 34 compresses the exhaust gas having passed through the dry dust collector 32. Thus, the flow pressure of the exhaust gas increases. The exhaust gas is compressed by the gas compressor 34 before being branched to an ore feeding gas by the feeding gas pipe 40.

The carbon dioxide contained in the exhaust gas having passed through the compressor 34 is removed while passing through the carbon dioxide remover 36. Thus, the reduction efficiency of the exhaust gas can be increased. As the exhaust gas whose reduction efficiency has been increased is mixed with the reducing gas to be supplied to the reduction unit 20, the amount of reducing gas necessary for the reduction of the ores can be increased.

Meanwhile, as shown in FIG. 1, the ores charged toward the feeding gas pipe 40 through an ore supply pipe 12 are supplied to the reduction reactor 201 by means of the ore feeding gas flowing through the feeding gas pipe 40. The feeding gas pipe 40 is connected to the exhaust gas pipe 30 between the compressor 34 and the carbon dioxide remover 36. That is, the feeding gas pipe 40 is branched out from the exhaust gas pipe 30 to provide the ore feeding gas.

As shown in FIG. 1, the exhaust gas pipe 30 and the feeding gas pipe 40 pass through the heat exchanger 50. Thus, the heat exchanger 50 can exchange heat between the exhaust gas passing through the exhaust gas pipe 30 and the ore feeding gas passing through the feeding gas pipe 40. That is, as the sensible heat of the exhaust gas is transferred to the ore feeding gas, the temperature of the ore feeding gas can be increased.

As indicated by dotted arrows in the heat exchanger 50 of FIG. 1, the exhaust gas flow in the + (positive) x-axis direction and the ore feeding gas flows in the − (negative) x-axis direction. Thus, the flow direction of the exhaust gas is opposite to the flow direction of the ore feeding gas in the heat exchanger 50. As a result, as heat is mutually exchanged between the exhaust gas and the ore feeding gas efficiently, the temperature of the ore feeding gas can be smoothly increased to a desired temperature. Thus, the moisture in the fed ores is prevented from being condensed by using the ore feeding gas whose temperature has been increased. As a result, the ore particles are prevented from being adhered to each other due to condensation of moisture, thereby making it possible to smoothly feed the ores. Thus, the temperature of the ore feeding gas may be 150° C. to 300° C. In this case, moisture of the ore feeding gas can be prevented from being condensed under the pressure of 3 to 4 atm.

As shown in FIG. 1, the feeding gas pipe 40 includes a first feeding gas pipe part 401, a second feeding gas pipe part 403, and a third feeding gas pipe part 405. The first feeding gas pipe part 401 extends in a first direction, i.e., the x-axis direction. The second feeding gas pipe part 403 is connected to the first feeding gas pipe part 401. The second feeding gas pipe part 403 extends in a second direction crossing the first direction, i.e., the z-axis direction. The second feeding gas pipe part 403 extends vertically. The gas can be efficiently fed toward the reduction reactor 201 through the first feeding gas pipe part 401 and the second feeding gas pipe part 403. Meanwhile, the third feeding gas pipe part 405 is connected to the second feeding gas pipe part 403. The third feeding gas pipe part 405 extends in a direction crossing the second direction.

As shown in FIG. 1, the ore supply pipe 12 mutually connects the ore supplier 10 and the feeding gas pipe 40. The ore supply pipe 12 extends in the z-axis direction, i.e., a direction crossing the direction where the feeding gas pipe 40 extends. Thus, the ore supply pipe 12 can supply ores to the feeding gas pipe 40 by using gravity.

Figure 2:
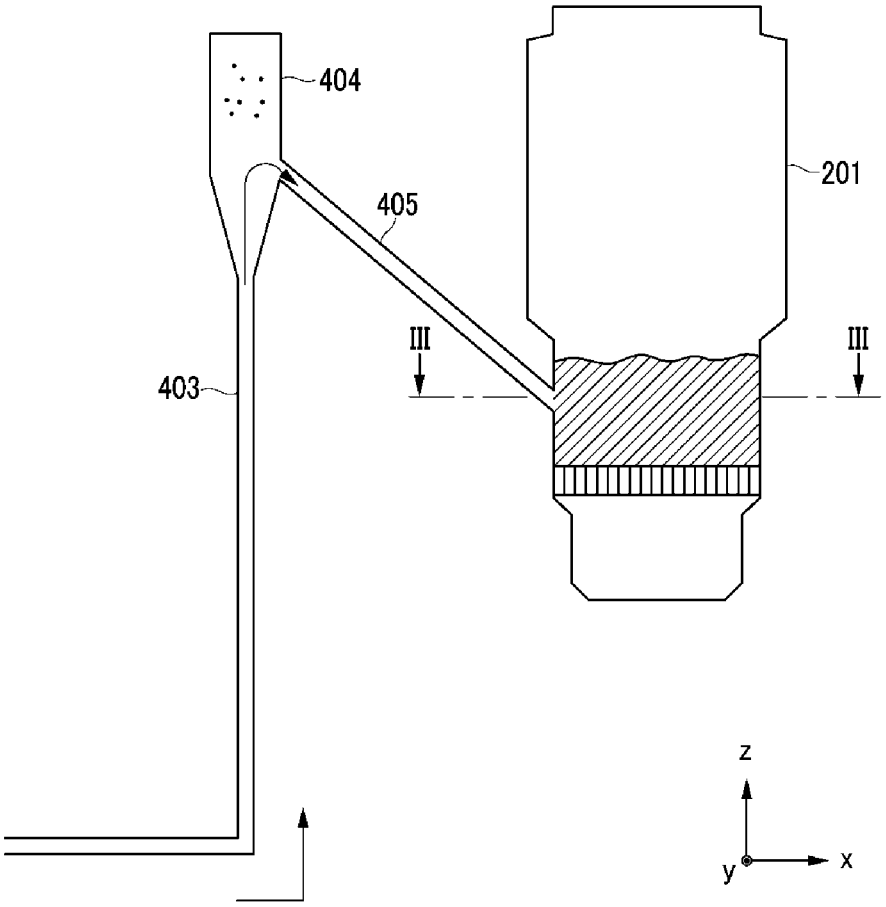
FIG. 2 is a schematic view where part II of FIG. 1 is enlarged.

FIG. 2 schematically shows an enlarged view of part II of FIG. 1. Although only one third feeding gas pipe part 405 is shown in FIG. 2, it is simply for an illustrative purpose of the present invention and the present invention is not limited thereto. Thus, the plurality of third feeding gas pipe parts 405 may be used.

As indicated by an arrow in FIG. 2, the dried ores are supplied in a first direction, i.e., the x-axis direction. Next, the dried ores rise again along the second direction, i.e., the z-axis direction. The amount of moisture in the dried ores fed along the x-axis direction may be more than 0 and not more than 7 wt %. When the amount of moisture in the ores exceeds 7 wt %, the ores may be attached to inner walls of the second feeding gas pipe part 403 and the third feeding gas pipe part 405 due to the moisture in the ores.

As shown in FIG. 2, a distributor 404 mutually connects the second feeding gas pipe part 403 and the third feeding gas pipe part 405. An air-tight space is formed within the distributer 404. Thus, the ores fed through the second feeding gas pipe part 403 flow within the distributor 404 while securing a sufficient flow space. Thus, even if a connecting portion of the second feeding gas pipe part 403 and the third feeding gas pipe part 405 is bent, the ores do not stay at the connecting portion but are smoothly fed into the reduction reactor 201 by changing their flowing direction at the direction of the arrow.

As shown in FIG. 2, the third feeding gas pipe part 405 is connected to the reduction reactor 201 to supply the dried ores to the reduction reactor 201. The dried ores are supplied to the reduction reactor 201 while descending along a third direction in which the third feeding gas pipe part 405 extends. Meanwhile, the ore feeding gas feeds the dried ores to the reduction reactor 201 along the third feeding gas pipe part 405. As a result, the direction in which the dried ores are supplied to the reduction reactor 201 coincides with the direction in which the ore feeding gas flows. The dried ores are supplied to the reduction reactor 201 in a linear flow. Thus, the ores can be continuously supplied to the reduction reactor 201 at a high speed.

Figure 3:
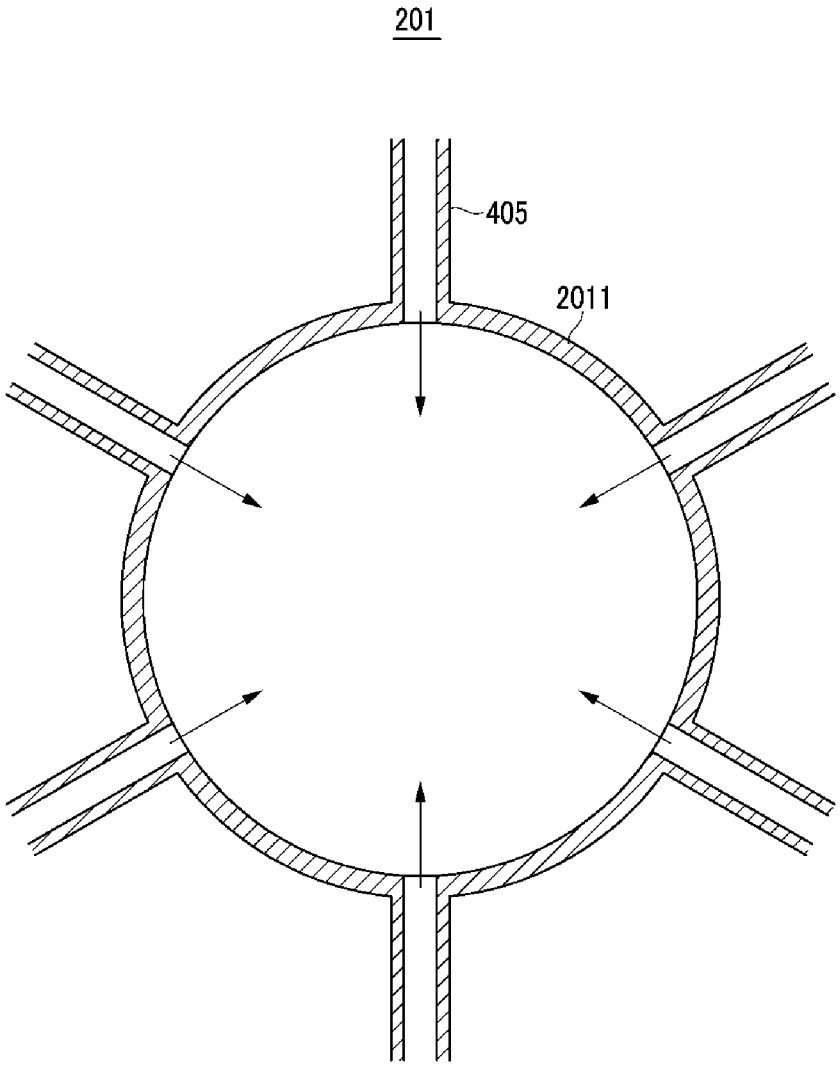
FIG. 3 is a schematic cross-sectional view taken along line III-III of FIG. 2.

FIG. 3 schematically shows a cross-sectional structure of the reduction reactor 201 taken along line III-III of FIG. 2.

As shown in FIG. 3, a plurality of third feeding gas pipe parts 405 are connected to an outer wall 2011 of the reduction reactor 201. The plurality of third feeding gas pipe parts 405 are radially connected to the reduction reactor 201 while forming a certain angle therebetween. Thus, the dried ores do not hamper the flow of the reducing gas flowing in the reduction reactor 201, and may be uniformly fed into the reduction reactor 201 radially along the direction of arrows through the plurality of third feeding gas pipe parts 405.

Figure 4:
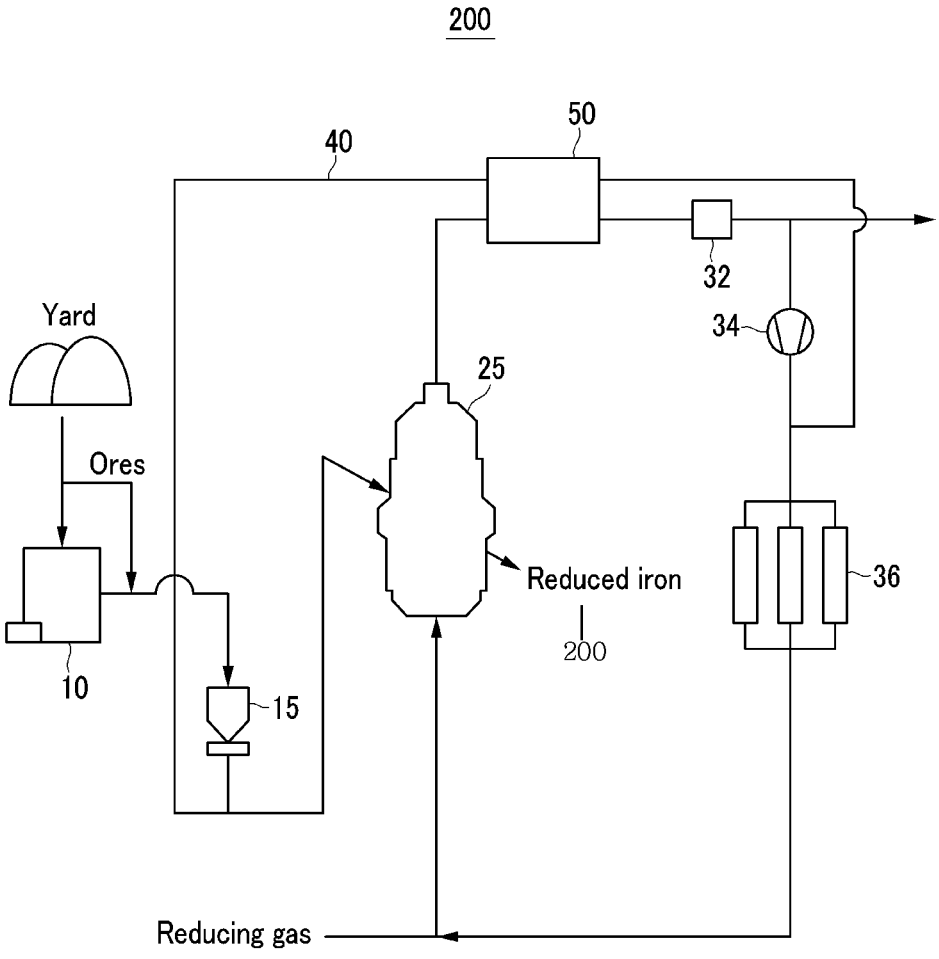
FIG. 4 is a schematic perspective view of an apparatus for manufacturing reduced iron according to a second exemplary embodiment of the present invention.

FIG. 4 schematically shows an apparatus for manufacturing reduced iron 200 according to the second exemplary embodiment of the present invention. The apparatus for manufacturing reduced iron 200 of FIG. 4 is the same as the apparatus for manufacturing reduced iron 100 of FIG. 1 except for a packed bed reduction reactor 25. Thus, the same reference numerals are given to the same parts, and a detailed description thereof will be omitted.

As shown in FIG. 4, the apparatus for manufacturing reduced iron 200 includes a packed bed reduction reactor 25. The dried ores are fed into the packed bed reduction reactor 25 to be filled. The filled ores are reduced with a reducing gas in the packed bed reduction reactor 25 and are converted to reduced iron. Reduced iron can be easily manufactured through the above-mentioned method.

Although the present invention has been described in the above description, it will be easily understood by those skilled in the art to which the present invention pertains that various changes and modification can be made without departing from the concepts and ranges of the following claims.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for manufacturing reduced iron, comprising:

drying ores in an ore drier;

supplying the dried ores to at least one reduction reactor;

reducing the ores in the at least one reduction reactor and manufacturing reduced iron;

discharging exhaust gas by which the ores are reduced in the at least one reduction reactor;

branching the exhaust gas and providing the branched exhaust gas as ore feeding gas; and exchanging heat between the exhaust gas and the ore feeding gas and transferring the sensible heat of the exhaust gas to the ore feeding gas, wherein in the supplying of the dried ores to the at least one reduction reactor, the dried ores are supplied to the at least one reduction reactor by using the ore feeding gas, and wherein the supplying of the dried ores to the at least one reduction reactor comprises supplying the dried ores along a first direction, supplying the dried ores along a second direction crossing the first direction and raising the dried ores along the second direction, and supplying the dried ores to the at least one reduction reactor through a plurality of third feeding gas pipe parts connected to the at least one reduction reactor in a radial direction.

2. The method for manufacturing reduced iron of claim 1, wherein in the supplying of the dried ores to the at least one reduction reactor, a direction in which the dried ores are supplied to the at least one reduction reactor coincides with a direction in which the ore feeding gas flows and the dried ores are supplied to the at least one reduction reactor in a linear flow.

3. The method for manufacturing reduced iron of claim 1, wherein in the supplying of the dried ores along the first direction, an amount of moisture in the dried ores supplied along the first direction is more than 0 and not more than 7 wt %.

4. The method for manufacturing reduced iron of claim 1, wherein the supplying of the dried ores to the at least one reduction reactor further comprises flowing the dried ores in an air-tight space between the second direction and a third direction.

5. The method for manufacturing reduced iron of claim 1, wherein in the branching of the exhaust gas and providing the branched exhaust gas as the ore feeding gas, the exhaust gas is compressed before being branched.

6. The method for manufacturing reduced iron of claim 1, wherein in the branching of the exhaust gas and providing the branched exhaust gas as the ore feeding gas, after dust contained in the exhaust gas is collected in a dry fashion, the exhaust gas is branched.

7. The method for manufacturing reduced iron of claim 1, wherein in the transferring of the sensible heat of the exhaust gas to the ore feeding gas, a flow direction of the exhaust gas is opposite to a flow direction of the ore feeding gas in a heat exchanger.

8. The method for manufacturing reduced iron of claim 1, wherein in the supplying of the dried ores to the at least one reduction reactor, a temperature of the ore feeding gas is 150° C. to 300° C.

* * * * *